United States Patent [19]

Watellier

[11] 4,342,431

[45] Aug. 3, 1982

[54] DISPENSING UNIT FOR SHEET AND/OR RIBBON PRODUCTS PACKAGED IN REELS

[76] Inventor: Christian Watellier, 54, route de Lens, 62660 Beuvry, France

[21] Appl. No.: 196,762

[22] PCT Filed: Sep. 28, 1979

[86] PCT No.: PCT/FR79/00083

§ 371 Date: May 28, 1980

§ 102(e) Date: May 21, 1980

[87] PCT Pub. No.: WO80/00692

PCT Pub. Date: Apr. 17, 1980

[30] Foreign Application Priority Data

Sep. 28, 1978 [FR] France ..... 78 28324

[51] Int. Cl.[3] ..... B65H 19/04; B65H 35/00

[52] U.S. Cl. ..... 242/55.3; 242/68.7

[58] Field of Search ..... 242/55.3, 129.5, 68.7; 225/16, 46, 47; 211/2; 312/37–39

[56] References Cited

U.S. PATENT DOCUMENTS

| | | | |
|---|---|---|---|
| 2,062,418 | 12/1936 | King | 242/55.3 X |
| 2,450,496 | 10/1948 | Whiteley | 242/55.3 X |
| 2,872,264 | 2/1959 | Nehring | 312/39 |
| 2,921,689 | 1/1960 | Reimenschneider | 211/2 |
| 3,072,351 | 1/1963 | Connolley | 242/55.3 |
| 3,229,926 | 1/1966 | Weber | 242/55.3 |
| 3,281,032 | 10/1966 | Solomon | 225/16 |
| 3,467,330 | 9/1969 | Yavitch | 242/55.53 |

FOREIGN PATENT DOCUMENTS

| | | |
|---|---|---|
| 1211584 | 3/1966 | Fed. Rep. of Germany . |
| 1308989 | 11/1962 | France . |
| 1527057 | 5/1968 | France . |
| 1601778 | 10/1970 | France . |
| 2129450 | 10/1972 | France . |

*Primary Examiner*—Leonard D. Christian

*Attorney, Agent, or Firm*—Kerkam, Stowell, Kondracki & Clarke

[57] ABSTRACT

A reeling display unit for sheet and/or ribbon products has a frame with at least one level receiving the sheet or ribbon in rolls. Each roll rests on a rear brace fixed to the frame and on a movable transverse bar sliding under the weight of the roll or rolls into engagement with a front brace secured to the frame. The sheet or ribbon products are fed upwardly between the transverse bar and the front brace to be retained there after desired lengths are cut therefrom.

5 Claims, 3 Drawing Figures

Figure 1:
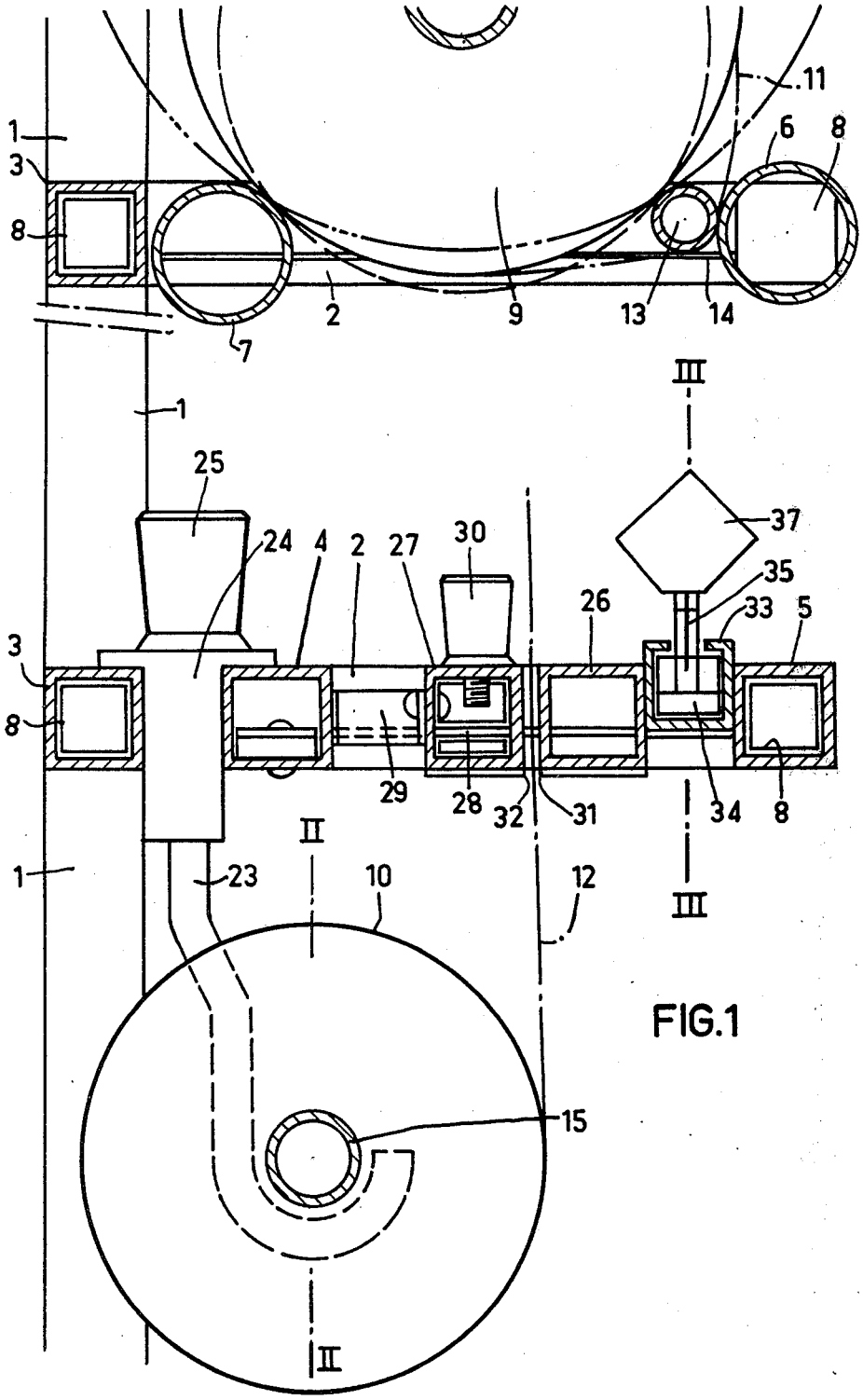

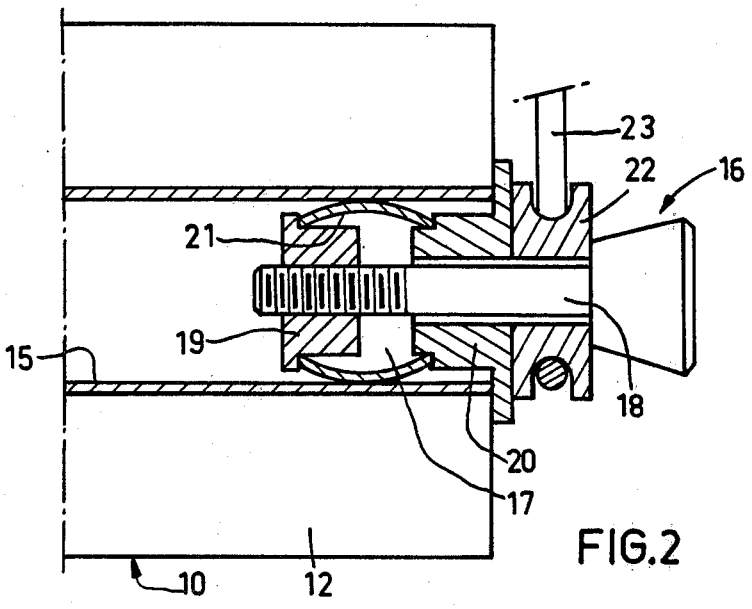
FIG.2
FIG.3
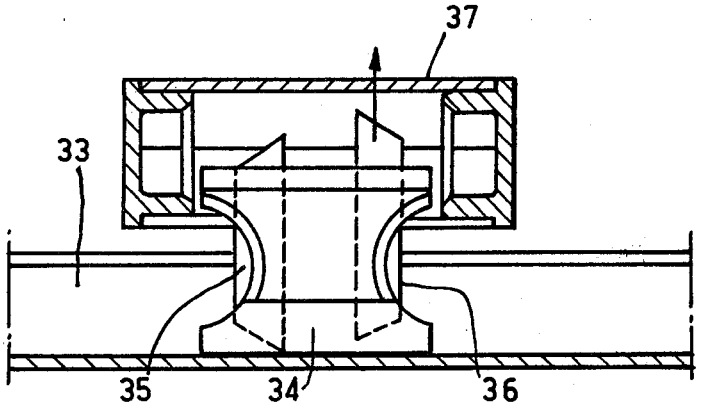

DISPENSING UNIT FOR SHEET AND/OR RIBBON PRODUCTS PACKAGED IN REELS

The invention relates to a reeling display unit for sheet and/or ribbon products packaged on reels, from which certain lengths of said products must frequently be taken.

Said reeling display unit is especially, but not exclusively, for use by florists.

In order to dress their floral presentations with a generally transparent sheet or film, e.g., of cellulose or polypropylene material, and/or a ribbon, florists must have available an assortment of ribbon of different sizes, styles, and colors, as well as sheets or films of distinct widths.

Therefore, in order to facilitate their choice, this entire assortment must be disposed on a reeling display unit which is as small as possible and enables the easy unrolling and cutting of a certain length of the sheet or ribbon chosen.

In presently known reeling display units, the spools of the reels are always slipped onto axes supported on a frame.

Because of this, each axis can support only one spool, which multiplies the number of axes to be provided and complicates the frame which supports them, failing which the replacement of one spool requires unloading several, which entails a great loss of time.

Whether done with a pair of scissors or with a cursor device, cutting is always done at a certain distance from the spool, if only to facilitate gripping the edge of the product for another cut.

Unfortunately, unless the reeling display unit comprises a counter-roller for lifting the product—which is rather complicated and bulky—this edge falls back over the reels on lower levels and interferes with their display and delivery. On the other hand, upstream from the cursor, with the sheet being free, cutting requires holding the two sides of the end of said sheet in order to obtain a clean cut.

Finally, with known reeling display units, after a certain time in stock, the sheet or ribbon product may have collected dust which may remain on the cut sheet and affect its appearance.

One result contemplated by the invention is a reeling display unit for ribbon or sheet products packaged on reels which will take up a small amount of space, cost little, and nevertheless be provided with effective means for lifting the edge of the product to facilitate grasping it and to prevent it from falling over the reels of products on lower levels.

Another result contemplated by the invention is such a reeling display unit, in which the sheet or ribbon is held at a point upstream from the cutting point in order to enable a clean cut by simply grasping the center of the edge of the sheet or ribbon, and which is also capable of ensuring the cleanliness of the sheet by removing possible dust particles.

Another result of the invention is such a reeling display unit which, although it comprises a series of reels placed side by side over at least one level, enables any of the reels to be replaced without requiring the others to be removed.

To do this, the object of the invention is a reeling display unit of the type described above, particularly characterized in that at each level it comprises two transversal jaws, upstream from the cutting point and located essentially in the same horizontal plane, which hold between them the product, which has previously been inserted between them from bottom to top.

The invention will be best understood using the following description, given by way of non-limitative example and with reference to the attached drawings, which represent:

FIG. 1 a radial cross-section of the reels supported on two different levels of the reeling display unit;

FIG. 2 a cross-section along II—II of FIG. 1;

FIG. 3 a cross-section along III—III of FIG. 1.

The display includes a frame which consists, for example, of uprights 1, beams 2, and braces 3, 4, 5, 6, 7, formed from assembled tubular sections.

Without departing from the scope of the invention, reels 9, 10 of product 11, 12 may be supported or suspended.

The ribbon reels are preferentially supported, in order not to multiply the suspension means reserved for products in large sheets.

In the supported reel version, the latter, with their side-pieces essentially side by side, are set on edge above two braces 6, 7 of the frame but actually rest directly only on rear brace 7, resting on forward brace 6 only through a transversal bar 13, mounted at its ends on guides 14, which are integral with crossbeams 2.

The weight of reels 9 then drives transversal bar 13 against brace 6.

This transversal bar 13 and forward brace 6 thus form jaws, both situated in the same essentially horizontal plane, between which, from bottom to top, is inserted product 11. In the case of a ribbon product, a cutting device might obviously be provided, but its narrow width and the fact that the user will nevertheless have to use scissors to shape and dress said ribbon dictate that cutting will generally be done with scissors, downstream from the jaws, so that the end of the ribbon thereby remains well held and in raised position for easy grasping.

Placed simply beside each other on beam 7 and bar 13, without use of any central spindle, the reels need not be removed whenever one of them must be changed. In the suspended reel version 10, in order likewise to avoid the central spindle which, given the width of the reel, would tend even more in this case to weigh down the display—spool 15 of reel 10 is, according to one characteristic of the invention, simple provided with mutually independent end stub assemblies 16.

These end stub assemblies preferentially consist of an expanding plug 17 which is centered and wedged into the opening of spool 15 upon activation of screw 18, which draws nut 19 toward ring 20, between which is arched a ring 21 in the shape of a deformable barrel. Either directly or through a ring 22, the outer part of stub 16 of each end of spool 15 is gripped by a hook 23, supported by a slide-block 24 which is moved transversally, using control knob 25, between two braces 3, 4 so as to adapt to the width of reel 10. Due to this fact, several reels may be placed essentially end to end on the same level. Similarly, for holding the edge of sheet 12 in raised position, the frame has two jaws 26, 27, upstream from the cutting point, consisting of two transversal bars, of which one (26) is integral with the crossbeams 2 of the frame, and the other (27) is mounted so as to slide on tracks 28, parallel to said crossbeams, with respect to which said tracks are stationary. Sliding jaw 27 is constantly pushed towards stationary jaw 26 by an elastic element such as a leaf spring 29, supported on one side against moving jaw 27 and on the other against a brace 4 of the frame. From bottom to top (so as not to fall back over the reels on lower levels), the edge of the sheet is initially inserted between the jaws, where the sheet will thus be held over its entire width, providing an excellent grip favorable to a clean cut, requiring nothing more than a simple hold at the center of the free edge. To facilitate the initial insertion of the sheet, sliding jaw 27 can be drawn back manually. As an aid in grasping it, it is equipped with a control knob 30. In order to avoid tearing the sheet thus held between the jaws, and in order further to clean it systematically, at least the active surfaces of jaws 26, 27 are provided with a lining 31, 32, e.g., of imitation felt. Downstream from the jaws, the frame is further equipped with a transversal bar 33, which forms a slide for a cursor 34, provided at each end with an interchangeable blade 35, 36. A head 37 facilitates grasping of the cursor and shields the ends of the blades.

I claim:

1. Reeling display unit for sheet and ribbon products packaged on reels, from which certain lengths of said products must frequently be taken by cutting, at a set point, using a cursor device or a pair of scissors, comprising a frame have a minimum of one level, means on said frame for supporting at least one reel and, slightly upstream from the cutting point, two transverse jaws on said frame situated essentially in the same horizontal plane holding the product between them, the product having previously been inserted from bottom to top between said jaws, further comprising at each level of the frame, in a horizontal plane, perpendicular braces and crossbeams, supporting side-pieces of the reels essentially side by side on edge above two of said braces of said frame and resting directly on only a rear one of said two braces, a transverse bar engaging the forward one of said two braces and taking the weight of the reels, guides supporting said transverse bar at opposed ends in said crossbeams, said transverse bar being pushed toward said forward brace by the weight of the reels, forming with said forward brace said two jaws for gripping the product.

2. Reeling display unit for sheet and ribbon products packaged on reels, from which certain lengths of the products must frequently be taken by cutting, at a set point, using a cursor device or a pair of scissors, comprising a frame having at least one level, means on said frame at said at least one level supporting at least one reel, two transverse jaws on said frame slightly upstream from said set point, situated essentially in the same horizontal plane holding the product previously inserted from bottom to top between said jaws, and further comprising at each level of said frame in a horizontal plane, perpendicular braces and crossbeams, sliding blocks moving over certain of said braces and means connected to said blocks for suspending the reels, said means further including two mutually independent end stubs centered and wedged directly into end openings of the spool of the corresponding reel.

3. Reeling display unit according to claim 2, each of said stubs consisting of an expanding plug and a ring carried by said suspending means.

4. Reeling display unit according to claim 2 or 3, said suspending means being an open hook.

5. Reeling display unit according to any one of claims 1 through 4, in which the two jaws consist of two transverse bars, one of said bars being stationary with respect to said frame, a track parallel to said cross beams the other of said bars being slidably mounted on said tracks and urged toward said stationary bar, and a lining for at least the active parts of said jaws for preventing tearing of and for cleaning the product.

* * * * *